US012534243B2

(12) United States Patent
Milella et al.

(10) Patent No.: US 12,534,243 B2
(45) Date of Patent: Jan. 27, 2026

(54) MACHINE FOR PACKAGING LONG PASTA

(71) Applicant: RICCIARELLI S.p.A., Pistoia (IT)

(72) Inventors: Vito Milella, Pistoia (IT); Alberto Mangani, Pistoia (IT)

(73) Assignee: RICCIARELLI S.P.A., Pistoia (IT)

( * ) Notice: Subject to any disclaimer, the term of this patent is extended or adjusted under 35 U.S.C. 154(b) by 0 days.

(21) Appl. No.: 18/861,938

(22) PCT Filed: Apr. 27, 2023

(86) PCT No.: PCT/EP2023/061153
§ 371 (c)(1),
(2) Date: Oct. 31, 2024

(87) PCT Pub. No.: WO2023/213684
PCT Pub. Date: Nov. 9, 2023

(65) Prior Publication Data

US 2025/0289603 A1 Sep. 18, 2025

(30) Foreign Application Priority Data

May 2, 2022 (IT) ..... 102022000008840

(51) Int. Cl.
*B65B 19/34* (2006.01)
*B65B 5/02* (2006.01)
(Continued)

(52) U.S. Cl.
CPC ..... *B65B 19/34* (2013.01); *B65B 5/024* (2013.01); *B65B 5/06* (2013.01); *B65B 7/20* (2013.01);
(Continued)

(58) Field of Classification Search
CPC ..... B65B 19/34; B65B 41/06; B65B 43/18; B65B 43/185; B65B 43/265;
(Continued)

(56) References Cited

U.S. PATENT DOCUMENTS 3,535,847 A 10/1970 Strohmeier et al.
5,054,761 A * 10/1991 Dietrich ..... B65B 43/18 271/99

(Continued)

FOREIGN PATENT DOCUMENTS

| | | | |
|---|---|---|---|
| DE | 19801194 | A1 | 7/1999 |
| IT | BO940181 | A1 | 10/1995 |
| JP | 3095770 | B2 | 10/2000 |

*Primary Examiner* — Himchan Song
(74) *Attorney, Agent, or Firm* — McGlew and Tuttle, P.C.

(57) ABSTRACT

A machine for packing long pasta such as spaghetti, fettuccine, bavette, linguine, and the like, the machine being of the intermittent filling type and comprising—a storage space for storing elongated cardboard boxes kept in flat arrangement, —a pre-opening area for the cartons, —a conveyor belt, provided with cradles for the open cartons, for forming and moving a line of cartons, the carrier conveyor including a deposition area where an open carton is deposited, —an apparatus for filling the open boxes along the conveyor belt, —a rotor, on the periphery of which at least three planet devices are hinged for taking and releasing the cartons, adapted to rotate in coordinated fashion with the rotation of the rotor so as to arrive in the storage space to take a carton kept in flat arrangement and, subsequently, to arrive, with the taken carton, in the pre-opening area so as to deform the carton in rhombus-like fashion, partially opening it, and then to release the carton on the deposition area, wherein the machine is so programmed as to implement two operative steps alternating each other over time, a first step of rotation of the rotor and contemporaneous forward movement of the conveyor belt, and a second step where the rotation of the rotor and the forward movement of the carrier conveyor stop.

19 Claims, 15 Drawing Sheets

(51) Int. Cl.

| | |
|---|---|
| ***B65B 5/06*** | (2006.01) |
| ***B65B 7/20*** | (2006.01) |
| ***B65B 43/18*** | (2006.01) |
| ***B65B 43/26*** | (2006.01) |
| ***B65B 43/52*** | (2006.01) |
| ***B65B 59/00*** | (2006.01) |

(52) U.S. Cl.
CPC ..... *B65B 43/185* (2013.01); *B65B 43/265* (2013.01); *B65B 43/52* (2013.01); *B65B 59/005* (2013.01)

(58) Field of Classification Search
CPC ..... B65B 43/305; B65B 43/52; B65B 5/024; B65B 5/06; B65B 59/005; B65B 7/20
See application file for complete search history.

(56) References Cited

U.S. PATENT DOCUMENTS

| | | | | |
|---|---|---|---|---|
| 6,383,123 | B1 * | 5/2002 | Ehring | B65G 47/848 493/52 |
| 2006/0089244 | A1 * | 4/2006 | Martini | B65B 43/185 493/315 |
| 2012/0011808 | A1 * | 1/2012 | Langen | B65B 43/145 53/235 |
| 2018/0222608 | A1 * | 8/2018 | Hutter | B65B 5/024 |
| 2021/0237385 | A1 * | 8/2021 | Fridolfsson | B65B 43/325 |

* cited by examiner

MACHINE FOR PACKAGING LONG PASTA

TECHNICAL FIELD

The present invention relates to machines for packaging food products; more particularly, the present invention relates to a machine for packaging long pasta, such as spaghetti, bucatini, fettuccine, linguine, and the like.

STATE OF THE ART

As it is well known, for packaging long pasta, such as spaghetti, bucatini, fettuccine, linguine, and the like, packaging machines are used, also called cartoning machines, that allow filling, with long pasta, cartons, i.e. cardboard boxes having a predominant longitudinal dimension.

Among the known machines, packaging machines of the intermittent type are known, that have the advantage of being constructively simple and flexible in carton format change, but, having a low-intensity discontinuous loading, do not allow high productivity and can have a carton filling speed of, maximum, 60 cartons per minute.

To overcome the productivity limits of the packaging machines of the intermittent type, continuous packaging machines have been developed, allowing filling up to 240 cartons per minute.

These machines have a storage space for cartons, that is a storage space containing flattened cartons, i.e. cartons of rectangular cross section that are so flattened that their rectangular shape is deformed so as to take the shape of a flattened rhombus.

A rotor continuously takes the flattened cartons from the storage space and, before depositing them on a transport catenary, pre-opens them in a so-called carton erecting step, wherein the flattened carton is deformed so as to take the shape of a more "open" rhombus.

Then, the rotor deposits the semi-opened cartons on the catenary, where front and back supports complete the deformation, giving the cartons a shape with rectangular cross-section. This step of taking the cartons, erecting them, and depositing them on the catenary is performed continuously. Always continuously, the catenary moves forward and also a structure provided with filling drawers is moved forward, parallel to the catenary; from a third weighting and depositing structure, the pasta falls into the filling drawers. The drawers filled with past "follow" the catenary with the open cartons, parallel thereto, and, whilst continuously moving, pushers push the pasta in the cartons. Once filled with pasta, the cartons pass in front of a closing section for closing the flaps of the cartons.

The machines of this type have high productivity, but are very complex and poorly flexible in carton format change. In fact, if cartons of different formats shall be filled with pasta, it is necessary to replace a high number of movable drawers, with significant costs for each format and long downtimes.

SUMMARY

An object of the invention is to solve the problems of the known machines for packaging long pasta.

Therefore, an important object of the invention is to provide a machine for packaging long pasta that is flexible in carton format change.

A further important object of the invention is to provide a machine for packaging long pasta that has high productivity.

A further important object of the invention is to provide a machine for packaging long pasta that is particularly compact with respect to similar machines.

These and further objects, that will be better described below, are achieved through a machine for packaging long pasta such as spaghetti, fettuccine, bavette, linguine, and the like, of the intermittent filling type, comprising

- a storage space for storing elongated cardboard boxes kept in flat arrangement,
- a pre-opening area for the cartons,
- a carrier conveyor, provided with cradles for the open cartons, for forming and moving a line of cartons, the carrier conveyor including a deposition area where an open carton is deposited,
- an apparatus for filling the open cartons along the carrier conveyor,
- a rotor, on the periphery of which at least three planet devices are hinged for taking and releasing the cartons, adapted to rotate in coordinated fashion with the rotation of the rotor so as to arrive in the storage space so as to take a carton kept in flat arrangement and, subsequently, to arrive, with the taken carton, in the pre-opening area so as to deform the carton in rhombus-like fashion, partially opening it, and then to release the carton on the deposition area, wherein the machine is so programmed as to implement two operative steps alternating each other over time, a first step of rotation of the rotor and contemporaneous forward movement of the carrier conveyor, and a second step where the rotation of the rotor and the forward movement of the carrier conveyor stop, wherein

- in the first step, the rotor is adapted to rotate for continuously depositing, on the carrier conveyor moving forwards, at least four open cartons in sequence,
- in the second step, when the rotor and the carrier conveyor have stopped, the filling apparatus is adapted to fill with long pasta at least four open cartons of the line of cartons arranged on the carrier conveyor.

The invention provides for embodiments as disclosed in the attached claims.

BRIEF DESCRIPTION OF THE DRAWING

The invention shall be better understood by following the description and the accompanying drawing, which show non-limiting examples of embodiment of the invention. More particularly, in the drawing.

DETAILED DESCRIPTION OF EMBODIMENTS

Figure 1:
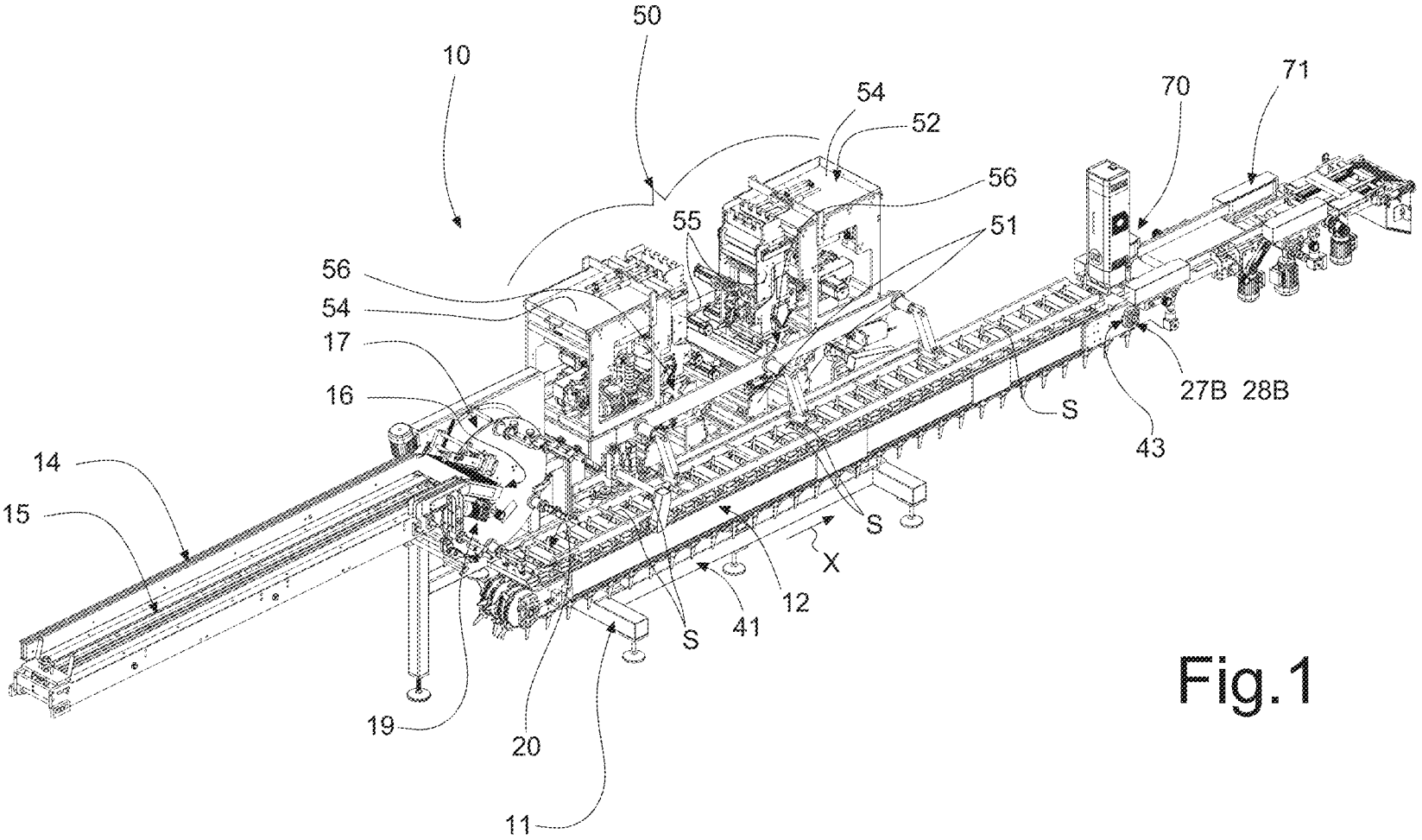
FIG. 1 is an axonometric schematic view of a machine according to the invention.

With reference to the cited figures, a machine for packaging long pasta such as spaghetti, fettuccine, bavette, linguine, and the like, of the intermittent filling type, is indicated as a whole with number 10.

The machine 10 comprises a support structure 11 for a carrier conveyor 12, along which open cardboard boxes or cartons S are moved and are filled with the pasta.

The cartons S are of the elongated type so as to contain long pasta and have a quadrangular cross section, preferably rectangular, having a mainly longitudinal extension so as to contain the elongated dimensions of the pasta. The first end section or face S1 and the second end section or face S2 of the cartons S are open before packaging so that they can be filled, as better described below. Each end face S1-S2 has four cardboard flaps, one per side, that shall be folded towards the inside of the section for closing the carton. More particularly, for the first end face S1 two first flaps S13 and S14 are provided, related to the opposite short sides of the face, and two second flaps S15 and S16 related to the opposite long sides of the face. Analogously, for the second end face S2 two first flaps S23 and S24 are provided, related to the opposite short sides of the face, and two second flaps S25 and S26 related to the opposite long sides of the face.

In this embodiment, the carrier conveyor 12 extend along a horizontal path, preferably a rectilinear path. A storage space 14 for cartons S is provided at a higher level than the carrier conveyor 12; in the storage space the cartons S are kept in flat arrangement, i.e. in such a way that the rectangular shape of the cartons is so deformed as to take the shape of a flattened rhombus, i.e. a rhombus with the inner opposite faces of greater dimensions touching each other.

The storage space 14 comprises an accumulation tank 15, which mainly extends longitudinally and where the flattened cartons accumulate, arranged with the flat faces put over one another and with the longitudinal axis of the tank that is approximately orthogonal to the cartons and mainly arranged according to a horizontal extension. In practice, the storage space defines a feeding path for the flattened cartons toward a pick-up area 16 where the storage space is open to allow taking the first carton of the series of stored cartons. The pick-up area 16 is provided at higher level than the carrier conveyor 12.

In this embodiment, the plan projection of the feeding direction of the cartons S in the storage space 12 is concord with the movement of the cartons on the carrier conveyor, i.e. they move in the same direction X.

Figure 4:
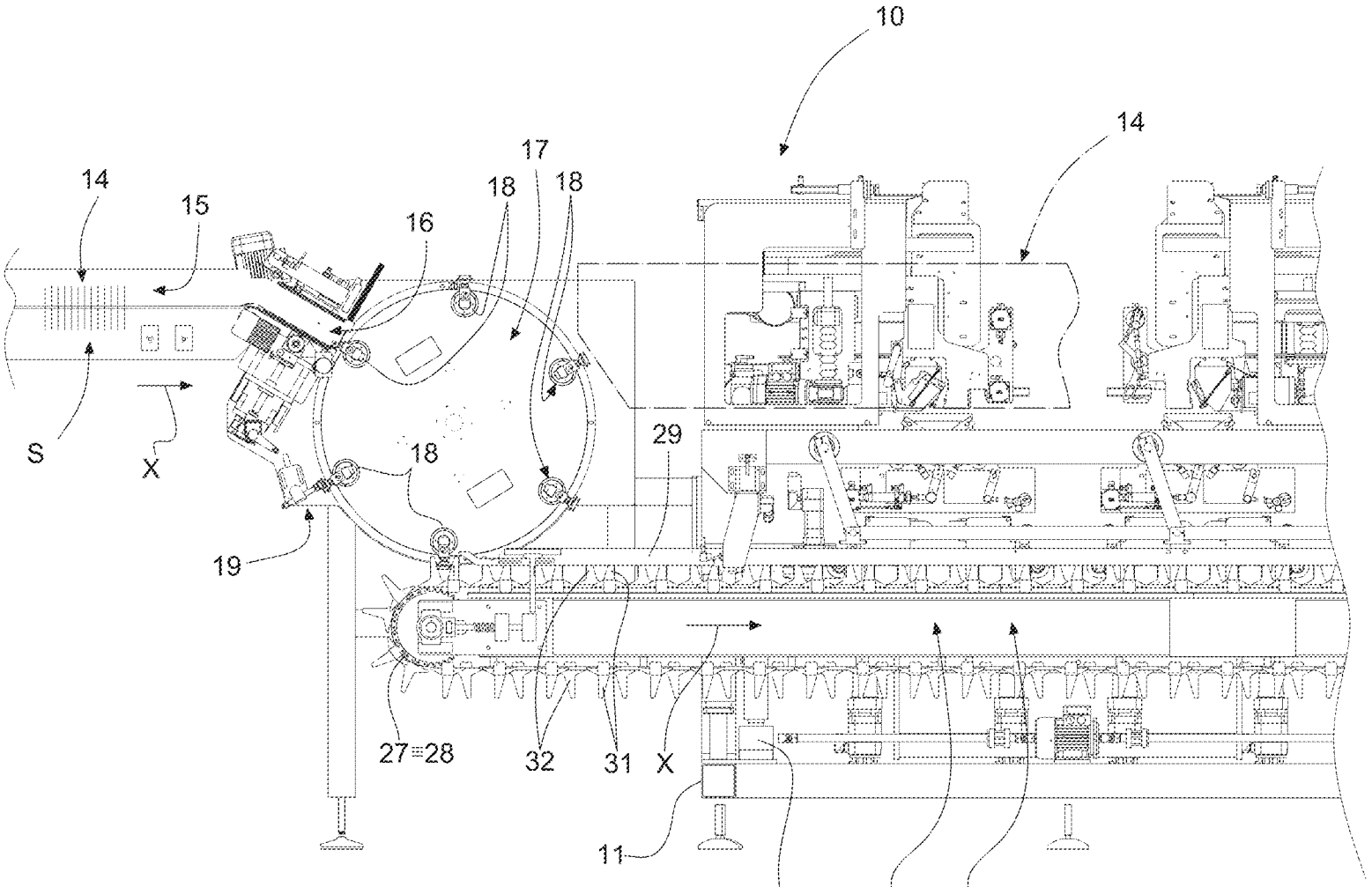
FIG. 4 is a side view of a central portion of the machine of FIG. 1, with no cartons.

In FIG. 4, a dash-dot line, put over the described example, schematically shows an alternative position for the storage space 14, where the plan projection of the feeding direction X1 of the cartons in the storage space is opposite to the plan direction X of the cartons moved by the carrier conveyor, and the tank overlaps, at least partially, the carrier conveyor, this resulting in a more compact configuration than that of the previous example.

The machine 10 also comprises a rotor 17, on the periphery of which a plurality of planet devices 18 are hinged (in this example, six planet devices, even if a different number of devices is possible, for example 3, 4, 5, 7, 8, etc.) for taking and releasing the cartons from the storage space 14 to the carrier conveyor 12, passing through an area 19 where the cartons are pre-opened.

Figure 6:
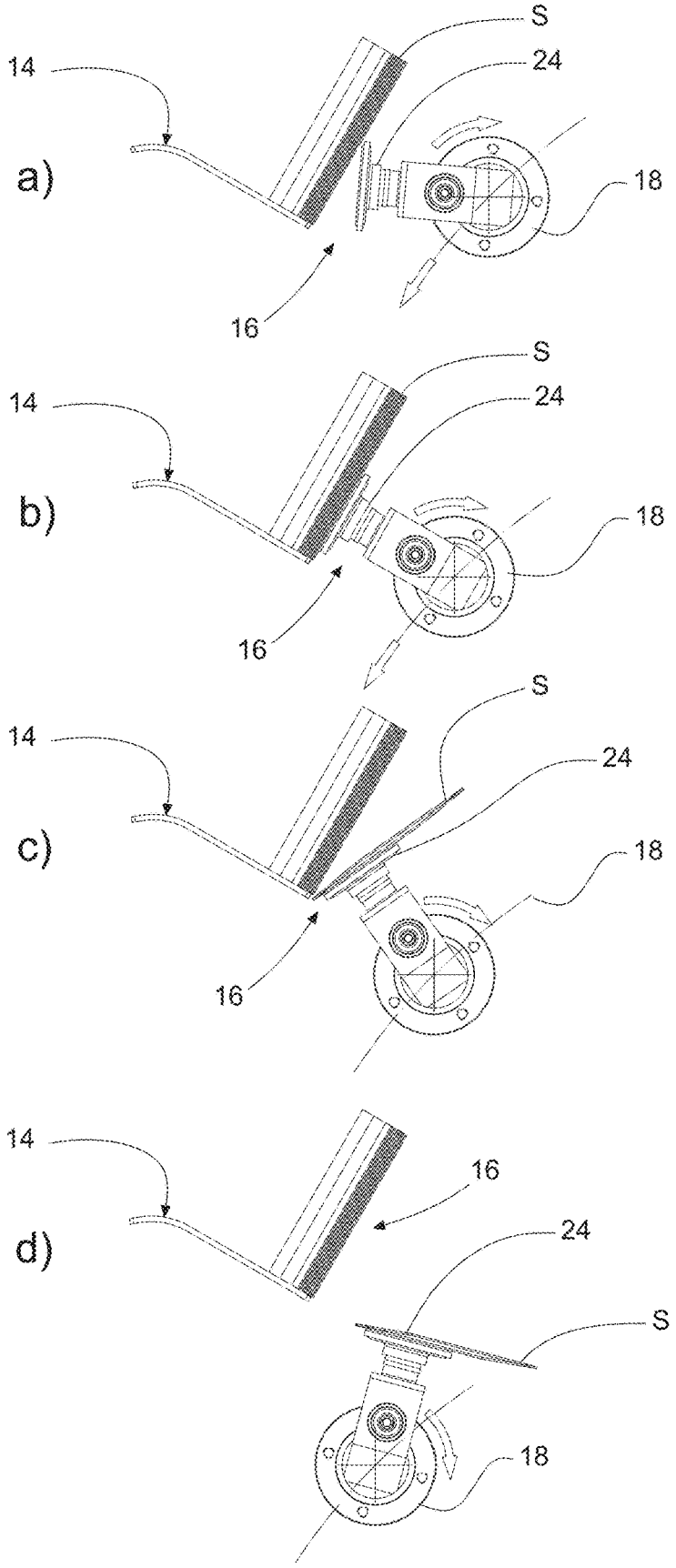
FIG. 6 shows four schematic side views of the taking and releasing steps, where a taking and releasing planet device takes a flattened carton from the storage space.
Figure 7:
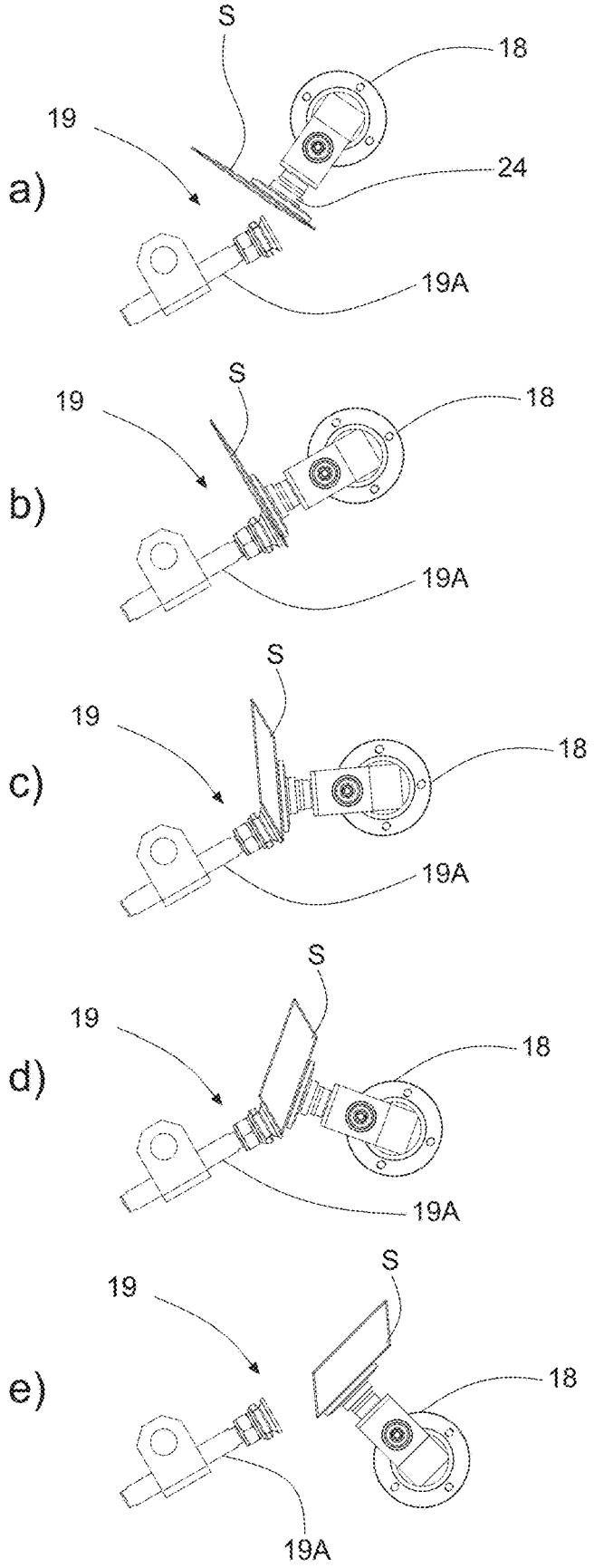
FIG. 7 shows five schematic side views of the steps of moving a taking and releasing planet device during the pre-opening of the cartons from a flattened configuration to a pre-opened configuration.

The planet devices 18 are adapted to rotate in coordinated fashion with the rotation of the rotor 17, so as to arrive in the pick-up area 16 of the storage space to take a carton S kept in flat arrangement (taking steps a-d shown in FIG. 6), and, subsequently, to arrive with the taken carton in the pre-opening area 19 so as to deform the carton in rhombus-like fashion, partially opening it, and then to release the carton on a deposition area 20 on the carrier conveyor 12, as schematized in the steps a-e of FIG. 7 and better described below.

The planet devices 18 for taking and releasing the cartons are arranged at the same angular distance on the periphery of the rotor (and at the same radial distance from the rotation axis of the rotor) and each device has a respective toothed wheel 21 engaging a common drive belt 22 that, in turn, engages a crown gear 23 coaxial with the rotation axis of the rotor and fixed with respect to the floor whilst the rotor rotates, so that all planet devices 18 have the same rotation ratio with respect to the rotor.

Each planet device 18 comprises a taking and releasing means, such as, for example, at least a suction cup 24 (in particular, in this embodiment, a pair of suction cups) associated with a pneumatic system for sucking air from the inside of the suction cup (for example, vacuum is generated by Venturi tubes provided on board the planet devices).

The pre-opening area has for example a pre-opening device 19A provided with at least one suction cup that holds, for a very short time interval, the face of the carton adjacent to (or, in other examples, opposite) the face that is taken and released by the planet device, so that the carton is blocked on a face and moved on the other face, thus causing the opening of the rhombus.

The carrier conveyor 12 comprises a plurality of cradles 25 for the cartons S.

Figure 4A:
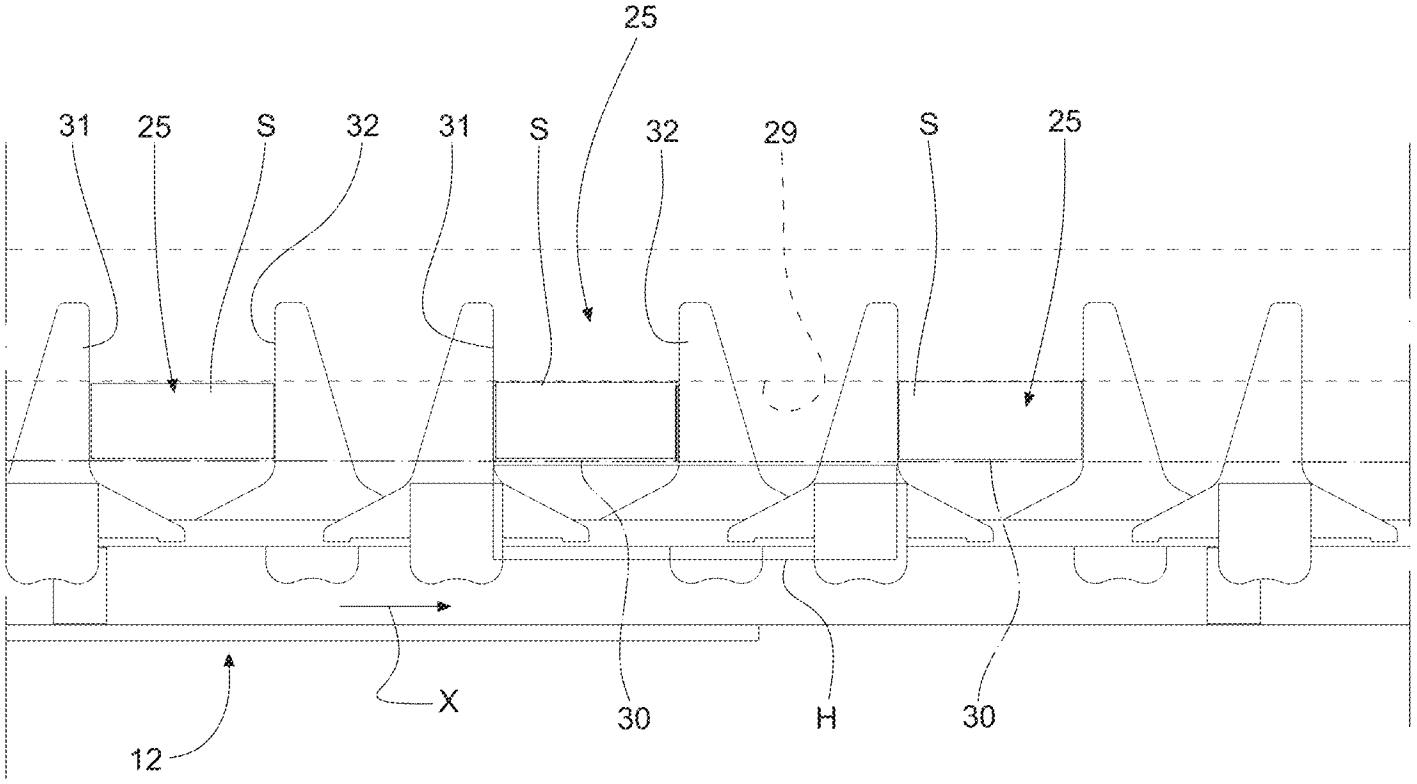
FIG. 4A is a schematic enlarged side view of a central portion of the machine of FIG. 1, highlighting the structure of the cradles of the carrier conveyor.
Figure 5:
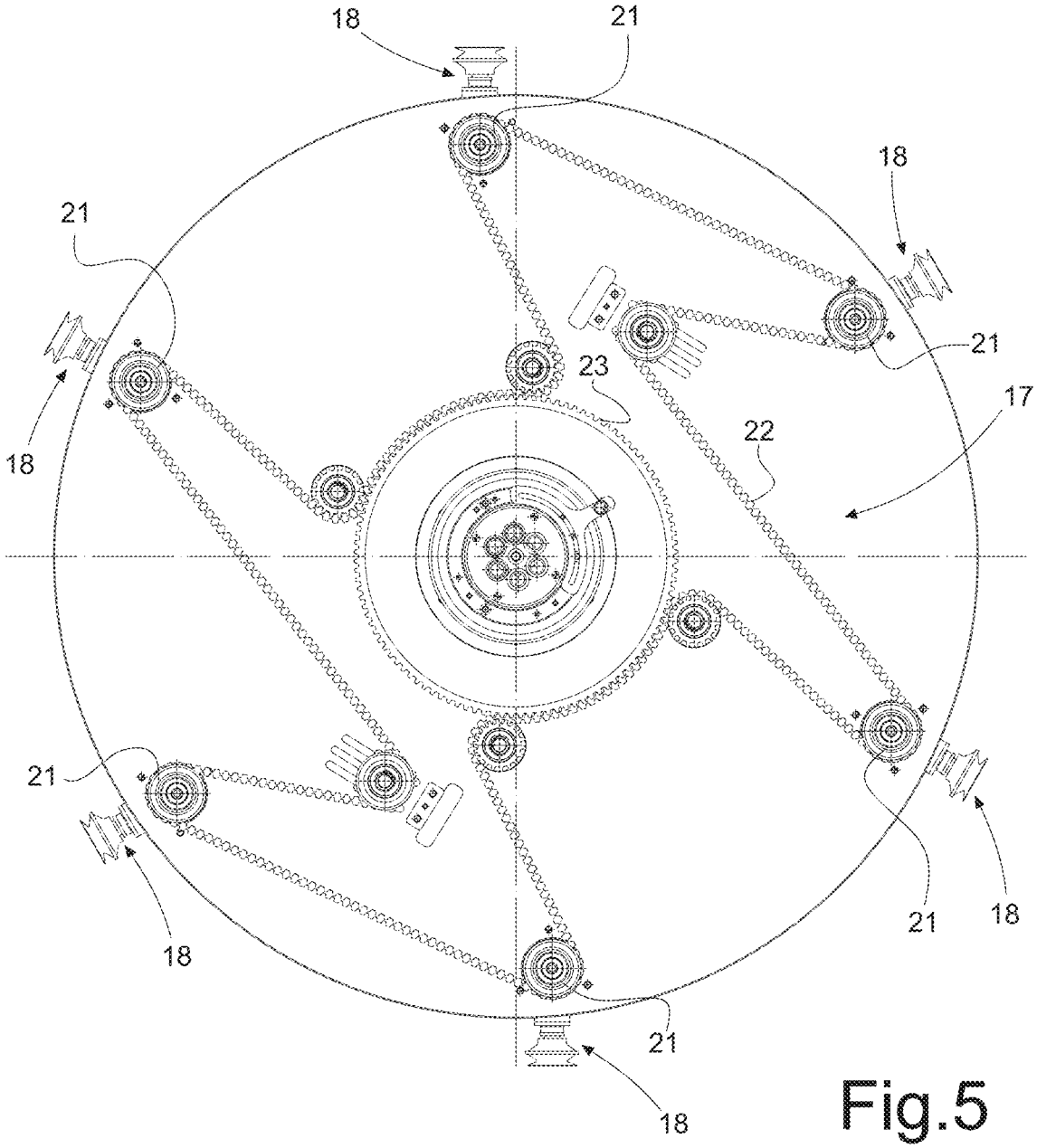
FIG. 5 is s rear side view of the rotor of the machine of the previous figures.

Each cradle 15 is preferably formed by at least a first flank, in this embodiment a pair of first flanks 31, and at least an opposite second flank, in this embodiment a pair of second flanks 32. In the cradles, the cartons rest on a bottom 30 (schematized through a dash-dot line in FIG. 4A).

The first and the second flanks move in the feeding direction X of the cartons in the carrier conveyor, with the first flanks 31 pushing the cartons in the direction X. In this embodiment, the bottom 30 where the cartons rest in the cradles does not move, as it is fixed with respect to the floor, so that the cartons slide on the bottom (that is therefore common to all cradles). In other examples, each cradle has an own bottom, defined for example by respective lower abutments provided on the lower parts of the flanks 31 and 32.

More particularly, in this embodiment the carrier conveyor 12 is formed by two conveyor belts closed in a loop, respectively a first conveyor belt 27 and a second conveyor belt 28, each of which has an upper segment for moving the cartons and a lower segment for returning.

Figure 2:
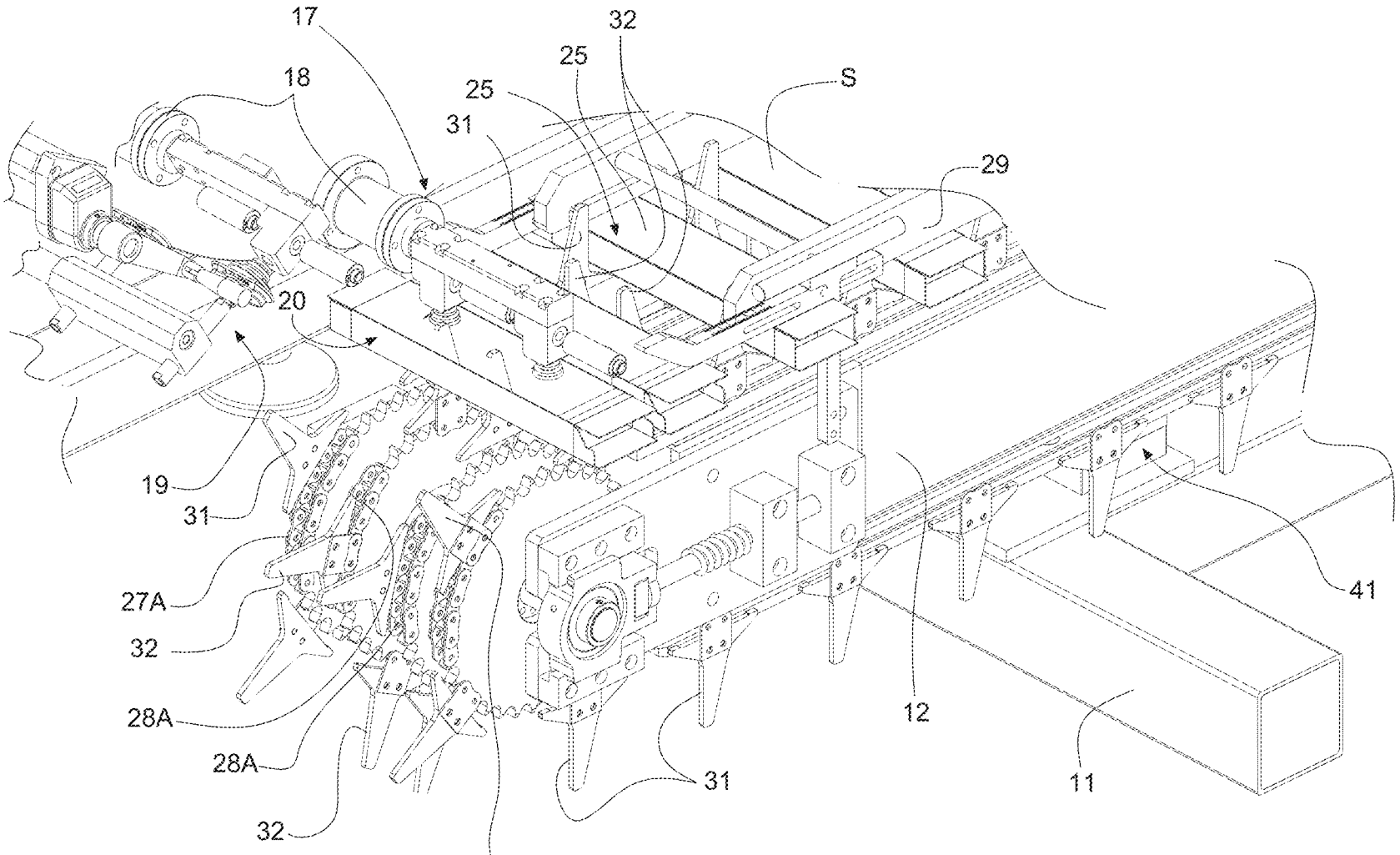
FIG. 2 shows a first enlarged portion of FIG. 1, with the beginning part of the carrier conveyor.
Figure 2A:
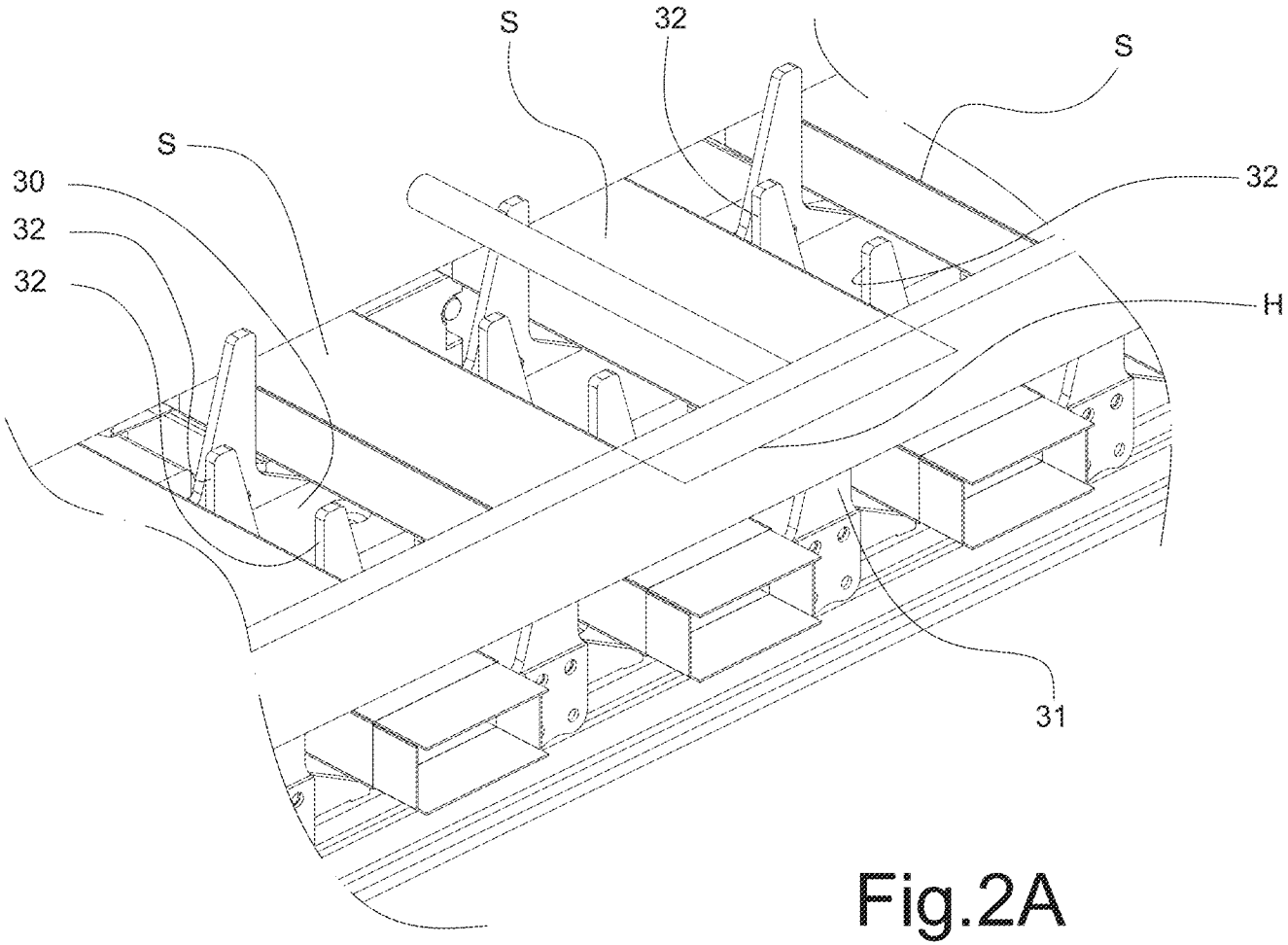
FIG. 2A shows second enlarged portion of FIG. 1, highlighting the cradles of the carrier conveyor.
Figure 2B:
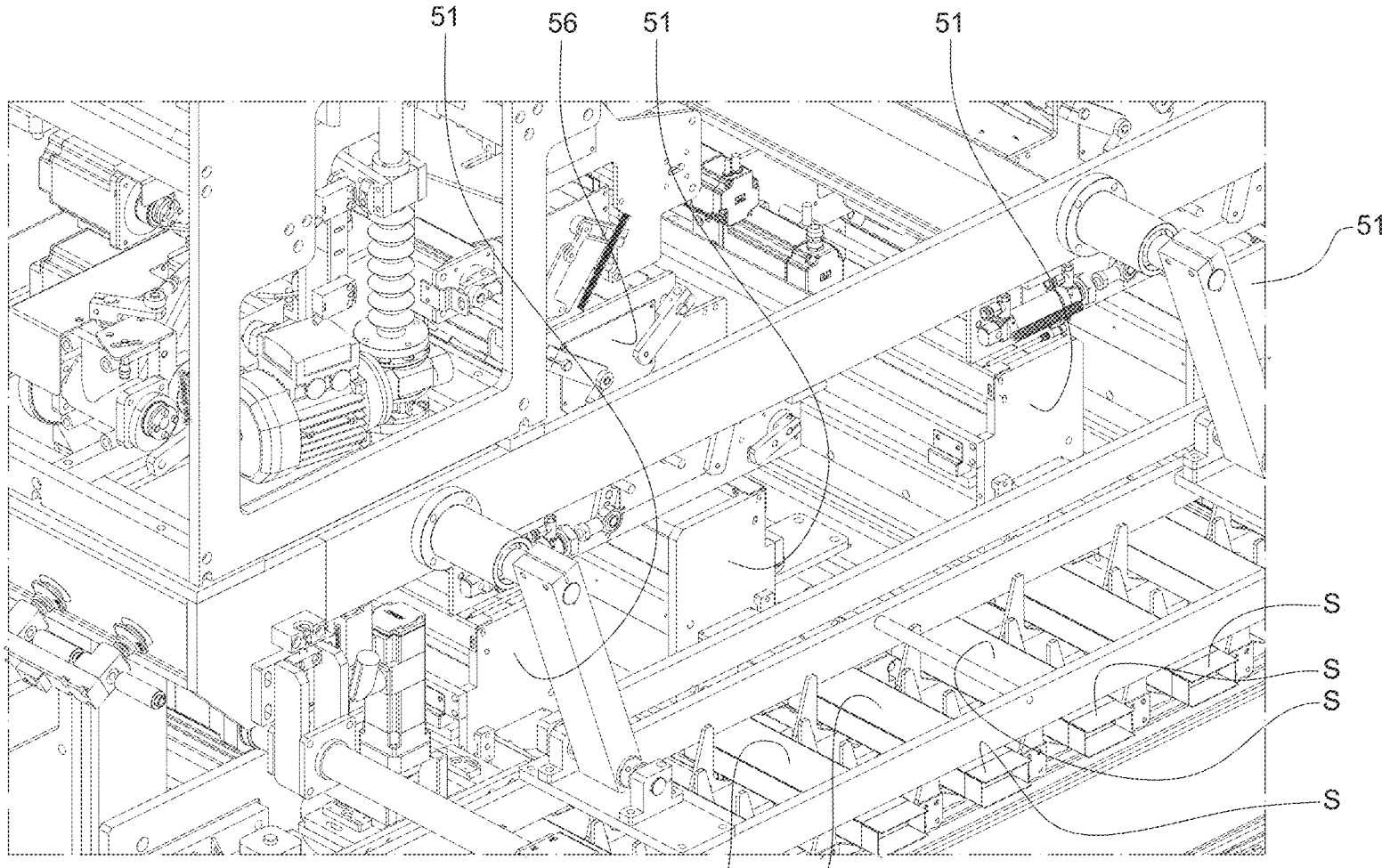
FIG. 2B shows a third enlarged portion of FIG. 1, with the central part of the carrier conveyor, highlighting the pasta filling drawers.
Figure 3:
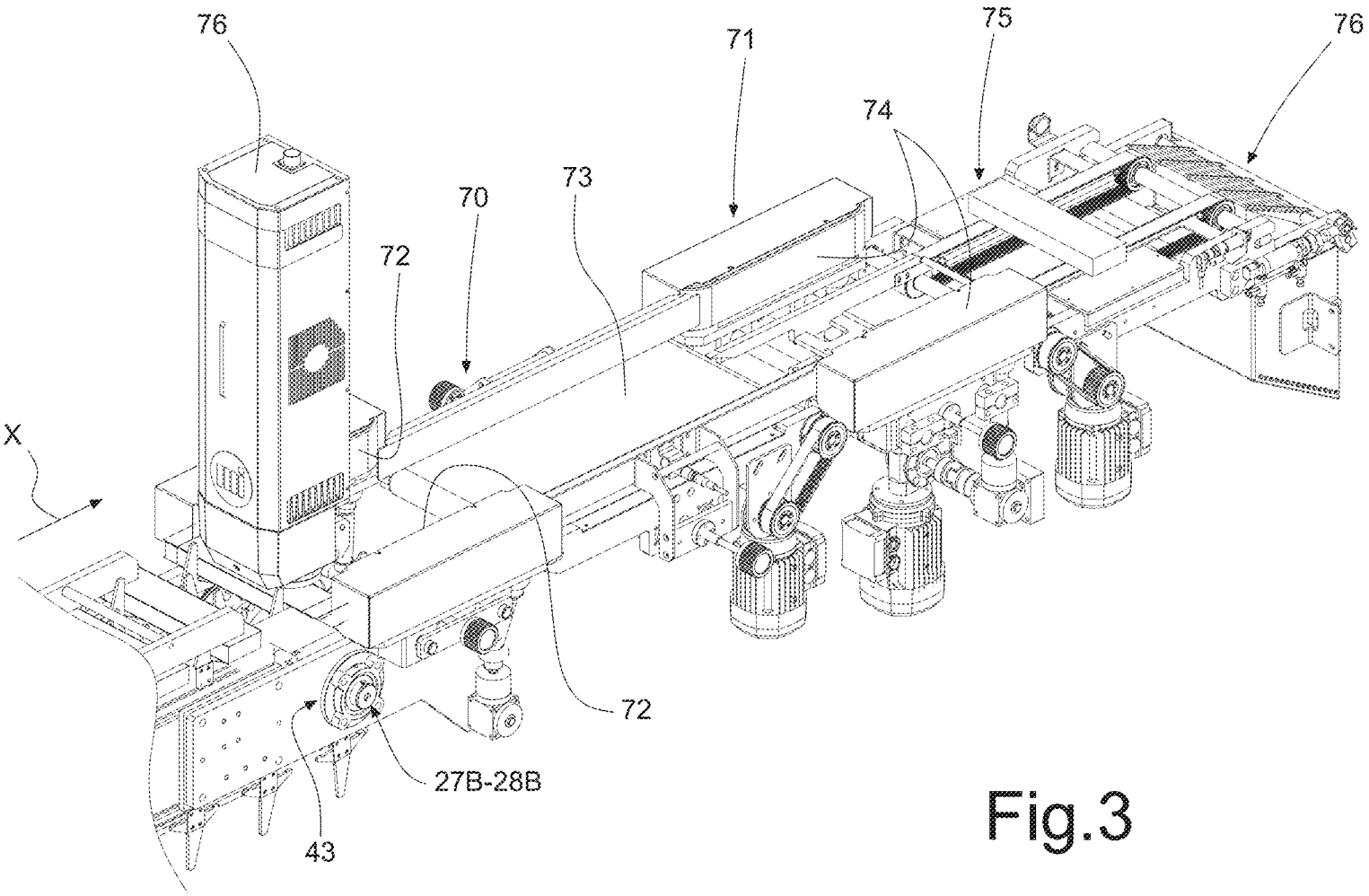
FIG. 3 shows a fourth enlarged portion of FIG. 1, with the final part of the carrier conveyor.

The first flanks 31 are fastened to the first conveyor belt 27, and the second flanks 32 are fastened to the second conveyor belt 28. The carrier conveyor 12 comprises, for example, two parallel chains wound on pinions. More particularly, as clearly shown in FIG. 2, the first conveyor belt 27 comprises two first parallel chains 27A provided on the outside of the carrier conveyor, bodies being fastened to the chains and defining the first flanks 31, whilst the second conveyor belt 28 comprises two first parallel chains 28A provided inside the carrier conveyor 12, that is between the first chains 27A. Bodies defining second flanks 32 are fastened to the second chains 28A.

On the upper segment of the carrier conveyor, the first and the second flanks 31 and 32 project upwards from the bottom 30, which is therefore arranged at a higher level that the chains carrying the flanks.

The two conveyor belts 27 and 28, in use, move at the same speed, and therefore also the respective chains with the flanks 31 and 32, i.e. allowing the movement of the cradles as a whole.

The two conveyor belts 27 and 28 are adequately moved by respective electric motors 27B and 28B.

To prevent the cartons S from exiting at the top from the cradles 25 whilst moving on the carrier conveyor 12, or preferably from vertically moving, an upper abutment system is provided limiting the vertical movement of the cartons, that comprises for example at least an abutment member 29 (preferably a pair of abutment members), for example a bar common to all cradles and arranged above the cradles, preferably at the same height as, or at a slightly greater height than, that of the cartons. In this embodiment, the upper abutment system is preferably fixed with respect to the floor.

The cradles 25 are so sized as to contain a given format of carton S. When the format, i.e. the size of the carton, varies, it is necessary to vary the dimensions of the cradles.

In order to do it, the machine comprises an adjustment apparatus for adjusting the dimensions of the cradles for the cartons, comprising for example a regulator 41 for controlling the distance between the bottom 30, where the cartons S rest in the cradles, and the floor.

Thanks to the fact that the upper abutment system 29 is fixed with respect to the floor, by varying the height above the ground of the bottom 30 it is possible to adjust the space in height available for the cartons, i.e. to adjust the height of the cartons.

For example, the bottom 30 is fixed relative to the frame supporting the conveyor belts 27 and 28, i.e. fixed to the carrier conveyor 12, and the regulator 41 for controlling the distance of the bottom 30 from the floor comprises a vertical translation device for translating the carrier conveyor and therefore also the bottom 30 fixed thereto, that can comprise, for example, one or more translation actuators 41A of the pneumatic, oleo-dynamic or electromechanical type, interposed between the floor and the vertically movable part of the frame supporting the carrier conveyor with the bottom 30.

Furthermore, the adjustment apparatus for adjusting the dimensions of the cradles 25 comprises a control 43 for varying the width of the cradles 25. This control is adapted, for example, to vary the distance of the first flanks 31 from the second flanks 32 of the respective cradles. This can be done for example during a step of varying the width of the curves, through the relative movement of the first conveyor belt 27 relative to the second conveyor belt 28, i.e. by moving the two conveyor belts at different speeds during the variation step. In practice, by varying the relative rotation speed of the two independent electric motors 27B-28B of the conveyor belts, it is possible automatically to vary, during an adjustment step, the speed of the two conveyor belts and therefore of the respective opposite flanks of the cradles, that therefore move towards or away from one another, without the need of a manual intervention on the conveyor belts.

A filling apparatus 50 is provided along the carrier conveyor 12 for filling the open cartons S, deposited by the rotor 17 in the cradles 25.

The filling apparatus 50 comprises a plurality of drawers 51 arranged at the side of the carrier conveyor and facing filling positions where the cradles 25 carrying the cartons S stop in order to be filled.

A conveying device 52 is associated with the drawers 51 for carrying preset quantities of pasta in the drawers.

Pusher 53 are therefore provided, arranged at the side of, and aligned with, the drawers 51 (preferably one pusher for each drawer) according to a direction orthogonal to the direction X of the cradles on the carrier conveyor 12. For example, each pusher is essentially a piston moving orthogonally to the direction X and adapted to push, in a given instant, the pasta contained in the corresponding drawer with which it is aligned, so as to put it inside a respective carton S (passing through the first end section/face S1 of the open carton) that is in a cradle 25 of the carrier conveyor 12 when stopped in the position aligned with the drawer.

The conveying device 52 for carrying preset quantities of pasta in the drawers 51 is for example of a known type and comprises at least a hopper 54, from which the pasta is discharged on a weighting section 55 below, where it is weighted and from which a preset quantity, in weight, of pasta is sent to one or more drawers 51.

In this example, four drawers 51 are provided, and the conveying device 52 comprises two modules, each of which is formed by a hopper 54, a weighting section 55, a section 56 where the weighted pasta is subdivided into two portions of equal weight and is conveyed in two respective drawers 51.

Adequately, the machine is electronically controlled, for example by a PLC system or the like, and is so programmed as to implement two operative steps alternating each other over time, a first step of rotation of the rotor 17 and contemporaneous forward movement of the carrier conveyor 12, and a second step where the rotation of the rotor 17 and the forward movement of the carrier conveyor stop. After the second step, a new first step occurs, and so on.

In particular, in the first steps, the rotor 17 is adapted to rotate for sequentially and continuously depositing at least four open cartons in the cradles 25 of the carrier conveyor.

In the second steps, when the rotor 17 and the carrier conveyor 12 have stopped, the filling apparatus 50 is adapted to fill with long pasta at least four open cartons of the line of cartons arranged on the carrier conveyor.

The number of cartons S continuously deposited on the carrier conveyor 12 during the first step is preferably equal to the number of drawers provided, or operating, during the second step.

In the embodiment of the cited figures, the number of drawers and cartons is four. In other embodiments, this number can be greater, for example 5, 6, 7 or 8.

From a practical viewpoint, it is possible to define the space H between the beginning of a cradle and the beginning of the subsequent one as moving unit of the carrier conveyor 12.

In the first steps, the carrier conveyor 12 is moved by a multiple of the moving unit H; more particularly, by a number of moving units H equal to the number of cartons deposited on the carrier conveyor. In the illustrated example, the carrier conveyor 12 is moved by four moving units H.

The filling apparatus 50 is so configured that the drawers 51 are spaced from one another by a space equal to at least one moving unit H of the carrier conveyor.

Figure 11:
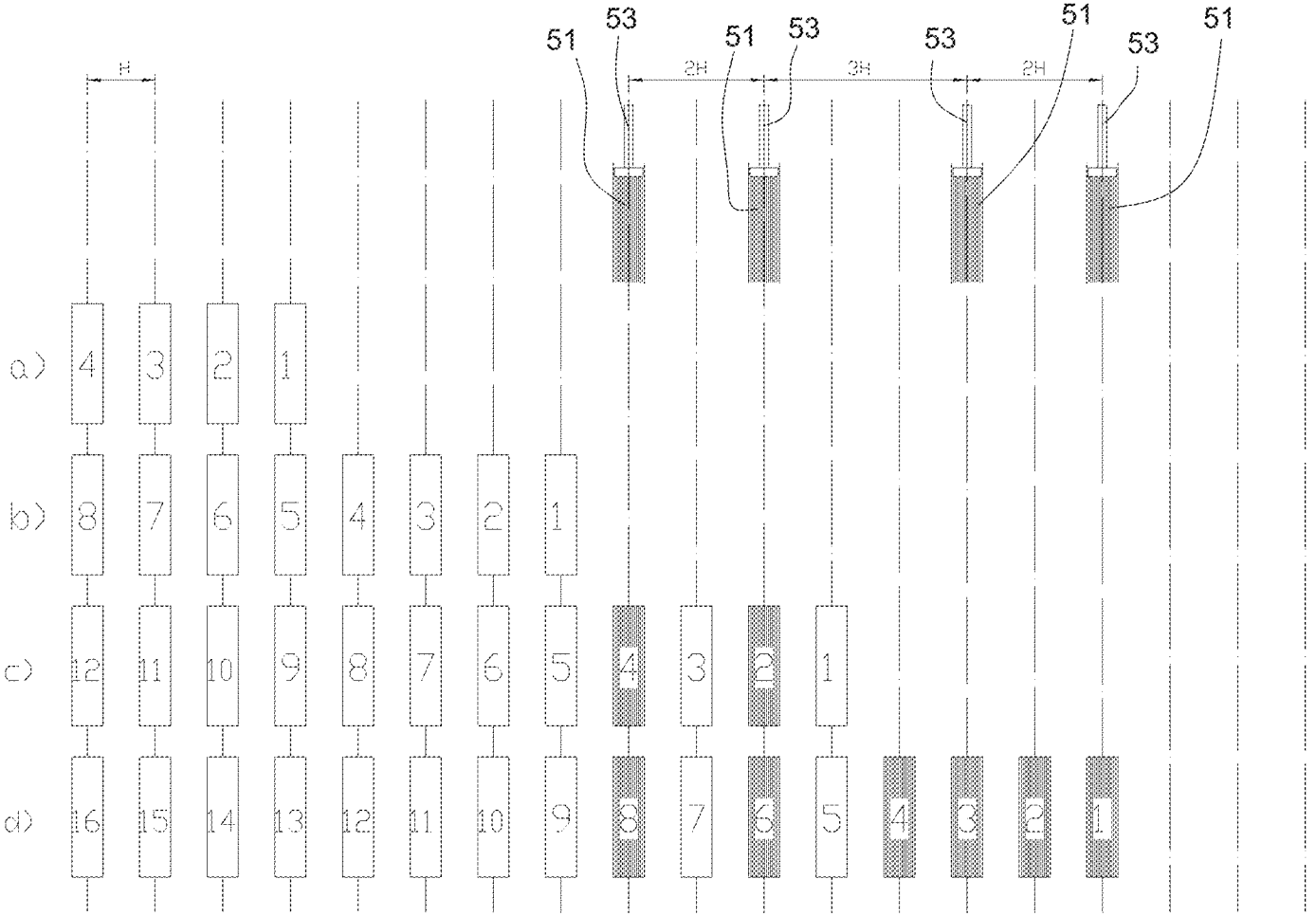
FIG. 11 shows a diagram of the steps of filling the cartons, in the case of four drawers.

If four drawers 51 are provided, the filling apparatus 50 comprises a first pair of drawers 51' and a second pair of drawers 51", wherein the drawers of each pair are spaced from each other by two moving units H of the carrier conveyor, and the first pair 51' is spaced from the second pair 51" by three moving units H, as shown in the diagram of FIG. 11.

Between the deposition area 20 on the carrier conveyor 12 and the first drawer, a space is provided preferably corresponding to eight moving units H or, in general, to a multiple of four moving units H.

Figure 12:
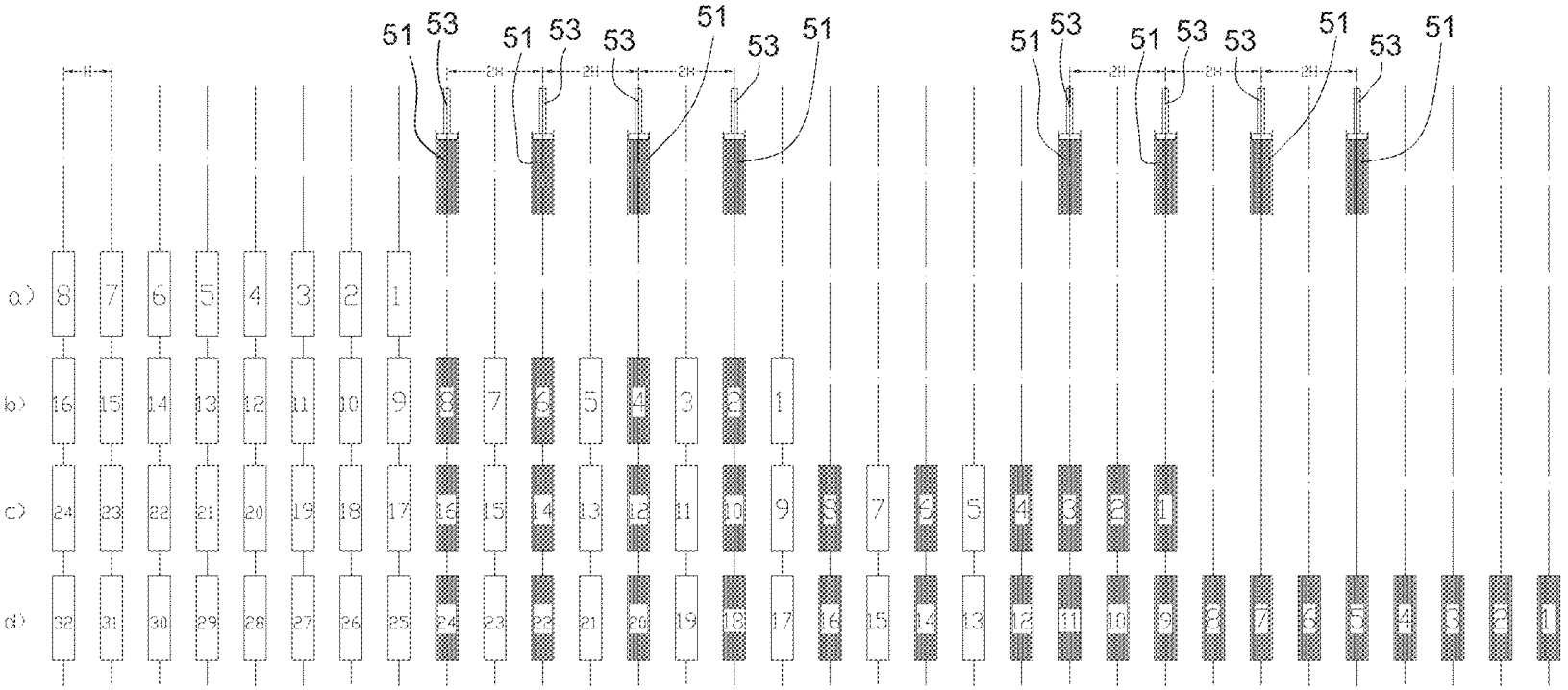
FIG. 12 shows a diagram of the steps of filling the cartons, in the case of eight drawers.

In a further preferred embodiment, the filling apparatus 50 comprises eight drawers. The diagram of FIG. 12 shows an example of the arrangement of the drawers along the carrier conveyor, highlighting the distance based on the moving units H, as better described below.

Figure 9:
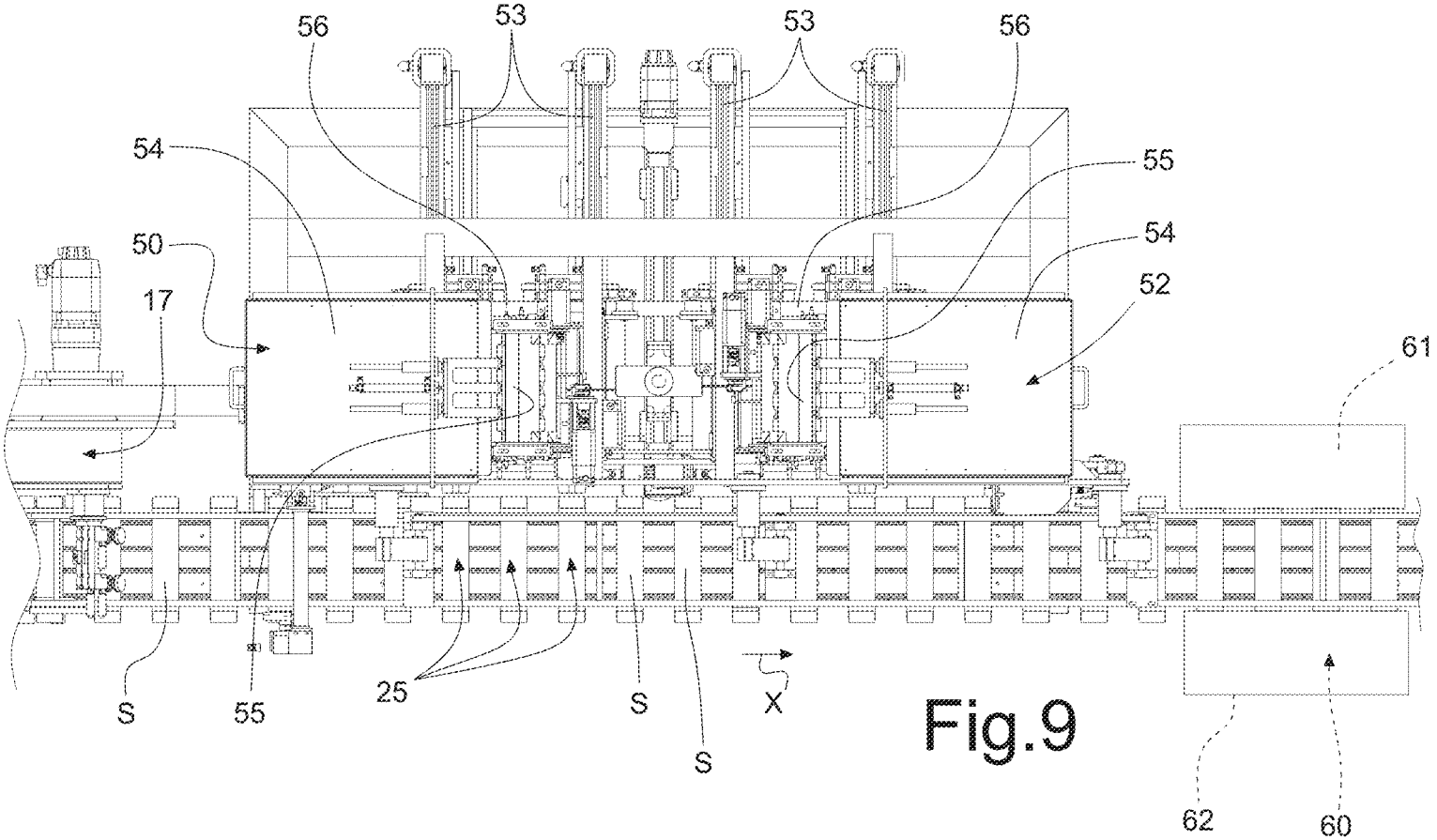
FIG. 9 is a schematic plan view of a central portion of the machine of FIG. 1.
Figure 10:
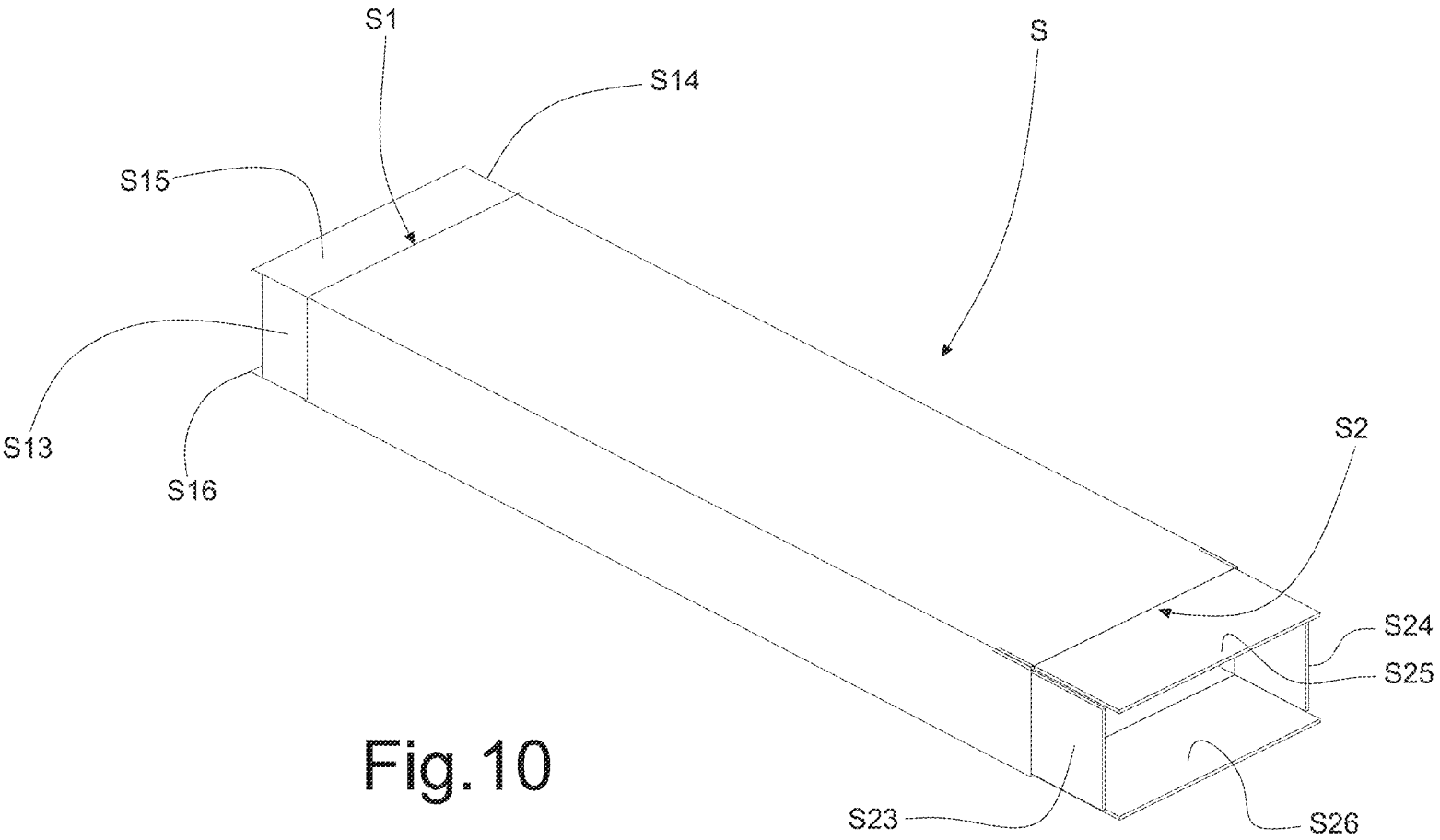
FIG. 10 is a schematic axonometric view of a carton open at the ends that shall be filled in a machine according to the invention.

An apparatus 60 is provided along the carrier conveyor 12 for closing, at least partially, the flaps of the faces S1-S2 of the cartons. The apparatus 60 is schematically indicated by a dotted line only in FIG. 9.

The apparatus 60 comprises a first closing module 61 arranged on the side the carrier conveyor corresponding to the first faces S1 of the cartons S, and a second closing module 62 arranged on the side of the carrier conveyor corresponding to the first faces S1 of the cartons S. The first module 61 is necessarily provided downstream of the last drawer 51 along the carrier conveyor 12, as it shall wait that the pasta has been inserted in the cartons. Preferably, also the second closing module 62 is provided downstream of the last drawer 51; in other embodiments, the second module is provided upstream of the last drawer.

The apparatus 60 for closing at least partially the flaps of the faces S1-S2 of the cartons is of a known type and it will be therefore not described below for the sake of simplicity. What is important to note is that each closing module can comprise fixed and movable abutments allowing to fold the flaps approximately on planes of the end faces S1-S2, gluing them. For example, each closing module 61-62 is provided with one or more glue dispenser (for example spray dispenser) for applying a line and/or dots of glue on at least the last second flap of the corresponding face S1-S2 that is closed so as to be folded over the other already folded flaps. The glue is preferably applied after having inserted the pasta in the cartons. The glue used for closing the cartons is for example of the hot-melt type.

Continuously after the carrier conveyor 12, according to a rectilinear direction, the machine comprises an exit line for the cartons S comprising a compression area 70, for sequentially compressing the filled cartons, and a subsequent launching module 71, for sending the cartons to a subsequent station according to a preset frequency.

For example, the compression area 70 is provided with a first extraction part from the carrier conveyor 12, providing for a pair of first belt walls 72 pushing the filled cartons S towards a subsequent compression area provided above a belt 73 on which the cartons slow down. In this embodiment, the bottom 30 where the cartons S rest from the carrier conveyor continues inside the first extraction part with first belt walls 72, so that the cartons rest on the bottom in this part. The launching module 71 is provided immediately downstream of the belt 73, and has two second belt walls 74 that "launch" the cartons into a control area 75 according to a present frequency. From the area 75 the cartons are preferably moved according to a direction transversal to the feeding direction X for exiting the machine. A discharge device 76 is provided downstream of the control area 75 according to the direction X, for discharging the non-conform cartons.

A printing device 76, for example of the laser type, is also provided along the feeding direction X of the cartons S, that allows to print on the cartons S. The device 76 is preferably provided downstream of the last drawer, for example above the end part of the carrier conveyor 12 or above the compression area 70.

The operation of the machine is as follows.

The carrier conveyor 12 could be completely devoid of cartons S.

The rotor 17 is driven into rotation. A planet device 18 is brought in correspondence of the pick-up area 16 of the storage space 14, where, through the taking means, takes a carton kept in flat arrangement (see FIG. 6).

The rotor 17 continues rotating, bringing the planet device 18 with the carton in flat arrangement in correspondence of the pre-opening area 19 (provided below the pick-up area 16, along the circular path of the planet device). In the area 19 the carton is deformed in rhombus-like fashion, partially opening in the end sections or faces S1-S2 (see FIG. 7).

Figure 8:
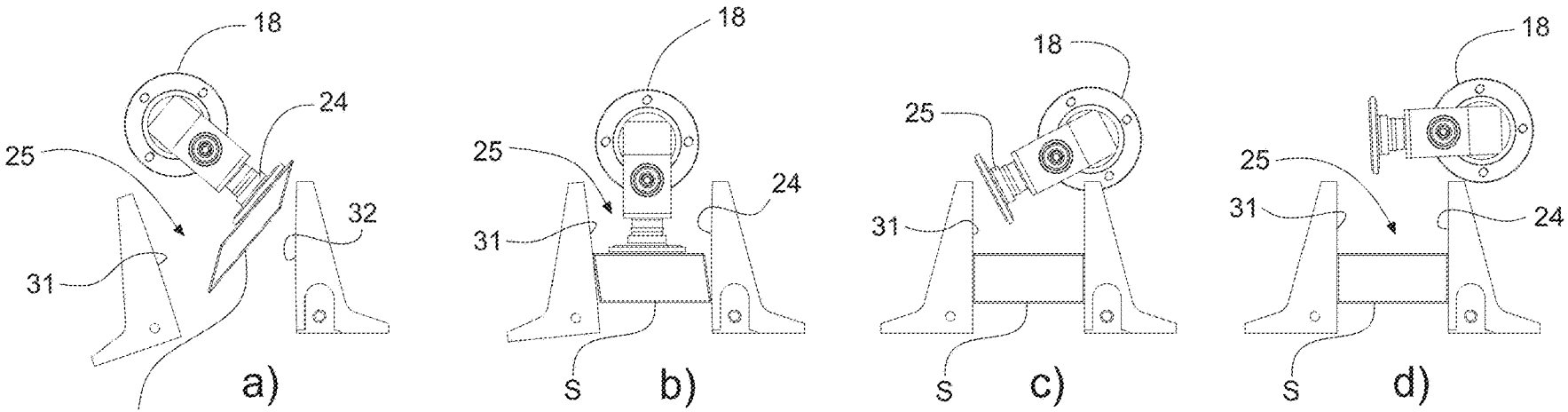
FIG. 8 shows four schematic side views of the steps of depositing a carton in a cradle of the carrier conveyor.

The rotor 17 continues rotating, bringing the planet device with the pre-opened carton on the deposition area 20 on the carrier conveyor 12, that is preferably defined at the beginning of the carrier conveyor (see FIG. 8). The deposition area 20 corresponds to the area of the carrier conveyor 12 where the first cradle 25 is formed, realized on the upper segment of the carrier conveyor. The insertion of the pre-opened carton between the flanks of the cradle causes a further deformation of the carton that is so deformed that the end faces are substantially open with approximately rectangular shape. Whilst the planet device 18 deposits the carton on the cradle 25, the rotor 17 and the carrier conveyor 12 move.

The rotor 17 and the carrier conveyor 12 move (first step) until the first four cartons 1-4 have been deposited (point a in FIG. 11). Then, the pushers of the drawers are actuated (second step) uselessly, with no pasta, as in front of the drawers there are no cartons, or the pushers are simply not actuated.

The first and the second steps are repeated until twelve cartons 1-12 are on the carrier conveyor (point c of FIG. 11). Here, a new second step provides for the first pair of drawers, filled with pasta (whilst the second pair is not filled with pasta as the cartons are aligned only with the first pair of drawers, or it is filled with pasta but the pushers are not actuated) to be pushed by the respective pushers into the cartons 2 and 4.

A new first step brings further four cartons 13-16 on the carrier conveyor, with the cartons 1 and 3 now aligned with the second pair of drawers, so that in a subsequent second step the cartons the cartons 1, 3, 6 and 8 are filled, thus completing the filing of the first four cartons 1-4 and starting filling the second four cartons.

FIG. 12 shows the case where eight cartons, with respective eight drawers, are deposited in sequence. In this example, two groups of drawers are provided, each comprised of four drawers 51, the drawers of each group being spaced in succession preferably by two moving units H. The first drawer of the second group is preferably spaced from the last drawer of the first group by seven moving units H. Preferably, between the deposition area 20 on the carrier conveyor 12 and the first drawer of the first group a space is provided corresponding to eight moving units H or, more in general, to a multiple of four moving units H.

Once the cartons have been filled, they move to the segment where the closing apparatus 60 is provided for closing the flaps of the cartons, so that the end faces of the filled cartons are closed.

From the apparatus 60, the closed cartons arrive to the compression area 70 for sequentially compressing the filled cartons, and then to the launching module 71, and then, if they are not discharged, to further stations where they are processed or stored.

It is understood that what is illustrated purely represents possible non-limiting embodiments of the invention, which may vary in forms and arrangements without departing from the scope of the concept on which the invention is based. Any reference numerals in the appended claims are provided for the sole purpose of facilitating the reading thereof in the light of the description above and the accompanying drawings and do not in any way limit the scope of protection.

The invention claimed is:

1. A machine for packaging long pasta, the machine being an intermittent filling machine, the machine comprising a storage space for storing elongated cardboard cartons kept in flat arrangement, a pre-opening area for opening the cartons, a carrier conveyor, provided with cradles for the open cartons, for forming and moving a line of cartons, the carrier conveyor including a deposition area where an open carton is deposited, a filling apparatus for filling the open cartons along said carrier conveyor, a rotor, on the periphery of which at least three planet devices are hinged for taking and releasing the cartons, adapted to rotate in coordinated fashion with the rotation of the rotor so as to arrive in said storage space to take a carton kept in flat arrangement and, subsequently, to arrive, with the taken carton, in the pre-opening area so as to deform the carton into a substantially rhombus shape, partially opening the carton, and then to release the carton on said deposition area, wherein the machine is so programmed as to implement two operative steps alternating each other over time, a first step of rotation of the rotor and contemporaneous forward movement of said carrier conveyor, and a second step where the rotation of the rotor and the forward movement of said carrier conveyor stop, wherein in the first step, said rotor is adapted to rotate for continuously depositing, on said carrier conveyor moving forwards, at least four open cartons in sequence, in the second step, when said rotor and the carrier conveyor have stopped, said filling apparatus is adapted to fill with long pasta at least four open cartons of the line of cartons arranged on the conveyor belt.

2. The machine of claim 1 comprising an adjustment apparatus for adjusting dimensions of said cradles for the cartons, to vary a size of the cartons to be filled in the plant.

3. The machine of claim 2, wherein said apparatus for adjusting the dimensions of the cradles comprises a regulator for controlling a distance between a bottom where the cartons rest in the cradles and a floor; an upper abutment system provided for limiting a height of the cartons, having fixed distance from the floor, wherein said bottom is adapted to vary in height for increasing or decreasing the distance of the bottom from the abutment system to vary a useful height of the cradles for the cartons; the regulator including a device for vertically translating said carrier conveyor.

4. The machine of claim 2, wherein the apparatus for adjusting the dimensions of the cradles comprises a varying device for varying a width of the cradles; the cradles having at least a first flank arranged on a first conveyor belt and at least a second opposite flank arranged on a second conveyor belt, wherein the first and second conveyor belts, during the normal movement of the cartons, move forwards at the same speed, and wherein, during a step of variation of the cradle width, the varying device includes a step of relative movement of the first conveyor belt with respect to the second conveyor belt; the first and second conveyor belts comprising movement electric motors independent from each other, so as to allow a width variation by varying the relative rotation speed of the electric motors during a step of varying the width of the cradles.

5. The machine of claim 1, wherein the rotor comprises at least four planet devices for taking and releasing the cartons.

6. The machine of claim 5, wherein the planet devices for taking and releasing the cartons are arranged at the same angular distance on the periphery of the rotor and wherein each device has a respective toothed wheel engaging a common drive belt that, in turn, engages a crown gear coaxial with the rotation axis of the rotor and fixed with respect to the floor whilst the rotor rotates, so that all planet devices have the same rotation ratio with respect to the rotor.

7. The machine of claim 1, wherein the planet devices comprise suction cups for taking and releasing the cartons.

8. The machine of claim 1, wherein the storage space is arranged higher than the carrier conveyor.

9. The machine of claim 1, wherein the storage space has an accumulation tank, which mainly extends longitudinally and where the flat cartons accumulate, and, at the end of said tank, an area where the cartons are taken by a taking and releasing planet device, wherein the cartons move in the accumulation tank according to a feed direction.

10. The machine of claim 9, wherein the plan projection of the feed direction of the cartons in the storage area is the same as the plan direction of the cartons moved by the carrier conveyor, or opposite to the plan direction of the cartons moved by the carrier conveyor, so that the tank overlaps, at least partially, the carrier conveyor.

11. The machine of claim 1, wherein the sequence of deposition of cartons by the rotor on the carrier conveyor moving forwards provides for depositing four open cartons, or six open cartons, or eight open cartons.

12. The machine of claim 1, wherein the filling apparatus comprises a plurality of drawers arranged at the side of the carrier conveyor, at least a conveying device for carrying preset quantities of pasta in the drawers, pushers, arranged at the side of, and aligned with, the drawers, adapted to push the pasta that is in the drawers into the cartons when the cartons have been arranged by the carrier conveyor at the side of, and aligned with, the drawers.

13. The machine of claim 12, wherein a number of drawers is equal to a number of cartons continuously deposited on the carrier conveyor during the first step.

14. The machine of claim 1, wherein the space between the beginning of a cradle and the beginning of the subsequent cradle is defined as moving unit of the carrier conveyor, and wherein, in the first step, the carrier conveyor is moved by multiple of moving units, wherein a number of moving units is equal to a number of cartons deposited on the carrier conveyor.

15. The machine of claim 1, wherein the filling apparatus comprises a plurality of drawers, spaced from one another by a space corresponding to at least one moving unit of the carrier conveyor.

16. The machine of claim 1, wherein the filling apparatus comprises a first pair of drawers and a second pair of drawers, wherein the drawers of each pair are spaced from each other by a space corresponding to two moving units of the carrier conveyor, and the first pair is spaced from the second pair by a space corresponding to three moving units; between the area where an open carton is deposited and the first drawer a space being provided corresponding to four moving units or to a multiple of four moving units.

17. The machine of claim 1, wherein the filling apparatus comprises eight drawers subdivided into two groups, each of which comprised of four drawers, wherein the drawers of each group are spaced in succession by two moving units; the first drawer of the second group is spaced by the last drawer of the first group by at least seven moving units; between the deposition area on the carrier conveyor and the first drawer of the first group a space is provided corresponding to eight moving units or, in general, to a multiple of four moving units.

18. The machine of claim 1, wherein continuously after the carrier conveyor an exit line is provided comprising a compression area for sequentially compressing the filled cartons and a subsequent launching module for sending the cartons to a subsequent station according to a preset frequency.

19. The machine of claim 1, comprising an apparatus, arranged along the carrier conveyor, for closing, at least partially, the flaps of the carton faces.

* * * * *